US007040873B2

(12) United States Patent
Dooley

(10) Patent No.: US 7,040,873 B2
(45) **Date of Patent: *May 9, 2006**

(54) MULTI PUMPING CHAMBER MAGNETOSTRICTIVE PUMP

(75) Inventor: Kevin Allan Dooley, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/056,268

(22) Filed: Feb. 14, 2005

(65) Prior Publication Data

US 2005/0147506 A1 Jul. 7, 2005

Related U.S. Application Data

(63) Continuation of application No. 10/034,054, filed on Dec. 27, 2001, now Pat. No. 6,884,040.

(51) Int. Cl.
*F04B 17/00* (2006.01)

(52) U.S. Cl. ..... 417/322; 417/418; 417/521

(58) Field of Classification Search ..... 417/322, 417/521, 418, 417, 415

See application file for complete search history.

(56) References Cited

U.S. PATENT DOCUMENTS 2,690,126 A * 9/1954 Alexis ..... 417/326
2,690,128 A 9/1954 Basilewsky
3,150,592 A * 9/1964 Stec ..... 417/322
3,754,154 A 8/1973 Massie
4,365,942 A 12/1982 Schmidt
4,585,397 A * 4/1986 Crawford et al. ..... 417/63
4,726,741 A 2/1988 Cusack
4,795,317 A 1/1989 Cusack
4,804,314 A 2/1989 Cusack
4,845,450 A 7/1989 Porzio et al.
4,927,334 A 5/1990 Engdahl et al.
5,129,789 A * 7/1992 Thornton et al. ..... 417/53
5,203,172 A 4/1993 Simpson et al.

(Continued)

FOREIGN PATENT DOCUMENTS

DE 40 32 555 A1 4/1992

(Continued)

OTHER PUBLICATIONS

PCT International Search Report—International Application No. PCT/CA02/01702—International Filing date: Jul. 11, 2002—Applicant: Pratt & Whitney Canada Corp.

*Primary Examiner*—Charles G. Freay
(74) *Attorney, Agent, or Firm*—Ogilvy Renault LLP

(57) ABSTRACT

A positive displacement pump includes a magnetostrictive actuator. A single actuator drives multiple pumping chambers. The pump may include two pumping chambers driven in phase by the linear expansion of the actuator at both its ends. The pump may include a third pumping cavity, driven by the transverse expansion and contraction of the actuator, out of phase with either cavity driven by the lengthwise extension of the actuator. A pump assembly having multiple pumps each including a magnetostrictive element is also disclosed.

8 Claims, 13 Drawing Sheets

U.S. PATENT DOCUMENTS

| | | | | |
|---|---|---|---|---|
| 5,215,446 | A | 6/1993 | Takahashi et al. | |
| 5,338,164 | A | 8/1994 | Sutton et al. | |
| 5,501,425 | A | 3/1996 | Reinicke et al. | |
| 5,558,504 | A | 9/1996 | Stridsberg | |
| 5,630,709 | A | 5/1997 | Bar-Cohen | |
| 5,641,270 | A | 6/1997 | Sgourakes et al. | |
| 5,720,415 | A | 2/1998 | Morningstar | |
| 5,798,600 | A | 8/1998 | Sager et al. | |
| 6,026,847 | A | 2/2000 | Reinicke et al. | |
| 6,059,546 | A | 5/2000 | Brenan et al. | |
| 6,074,179 | A | 6/2000 | Jokela et al. | |
| 6,170,921 | B1 | 1/2001 | Naerheim | |
| 6,884,040 | B1 * | 4/2005 | Dooley | 417/53 |

FOREIGN PATENT DOCUMENTS

| | | | |
|---|---|---|---|
| DE | 195 36 491 A1 | | 4/1997 |
| JP | 6-101631 | | 4/1994 |
| JP | 11 093830 | | 4/1999 |
| JP | 11 182437 | | 7/1999 |
| JP | 11-182437 | * | 7/1999 |

* cited by examiner

MULTI PUMPING CHAMBER MAGNETOSTRICTIVE PUMP

CROSS-RELATED APPLICATION

The present application is a continuation of U.S. patent application Ser. No. 10/034,054, filed Dec. 27, 2001, now U.S. Pat. No. 6,884,040, which is hereby incorporated by reference.

FIELD OF THE INVENTION

The present invention relates generally to pumps, and more particularly to pumps making use of magnetostrictive actuators.

BACKGROUND OF THE INVENTION

Conventional positive displacement pumps pump liquids in and out of a pumping chamber by changing the volume of the chamber. Many pumps are bulky with many moving parts, and are driven by a periodic mechanical source of power, such as a motor or engine. Often such pumps require mechanical linkages, including gearboxes, for interconnection to a suitable source of power.

Other types pumps, as for example disclosed in U.S. Pat. No. 5,64 1,270; and German Patent Publication No, DE 4032555A1 use an actuator made of a magnetostrictive material. As will be appreciated, magnetostrictive material change dimensions in the presence of a magnetic field. Numerous magnetostrictive materials are known. For example, European Patent Application No. 923009280 discloses many such materials. A commercially available magnetostrictive material is sold in association with the trademark TERFENOL-D by Etrema Corporation, of Ames, Iowa.

These magnetostrictive pumps rely on the expansion and contraction of a magnetostrictive element to compress a pumping chamber. Known magnetostrictive pumps however compress a single pumping chamber. As such, these pumps produce a single pumping compression stroke for each cycle of contraction and expansion of the magnetostrictive material. This, in turn, may result in significant pressure fluctuations in the pumped fluid. The flow rate is similarly limited to the displacement of the single-pumping chamber. Moreover, pumps with a single actuator may be mechanically imbalanced and thereby prone to mechanical noise and vibration as the single actuator expands and contracts.

In certain applications, constant pressures and high flow rates per unit weight of a pump are critical. For instance, in fuel delivery systems in aircrafts, pump designs strive to achieve low pump weight to fuel delivery ratios, while still providing for smooth fuel delivery.

Accordingly, an improved magnetostrictive pump facilitating high flow rates, and smooth fluid delivery would be desirable.

SUMMARY OF THE INVENTION

In accordance with the present invention, a pump includes a magnetostrictive element, and multiple pumping chambers all driven by this magnetostrictive element. The pumping chambers may pump fluid in or out of phase with each other.

Conveniently, a pump having multiple pumping chambers may provide for smoother fluid flow, less pump vibration, and increased flow rates.

In accordance with one aspect of the present invention, a pump includes a housing defining a cylindrical cavity; a cylindrical actuator formed of magnetostrictive material, within the housing and coaxial therewith; first and second pumping chambers within the housing at opposite ends of a lengthwise extent of the magnetostrictive element. Each of the pumping chambers is mechanically coupled to the actuator, to compress as the actuator extends in length.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of this invention.

DETAILED DESCRIPTION

Figure 1:
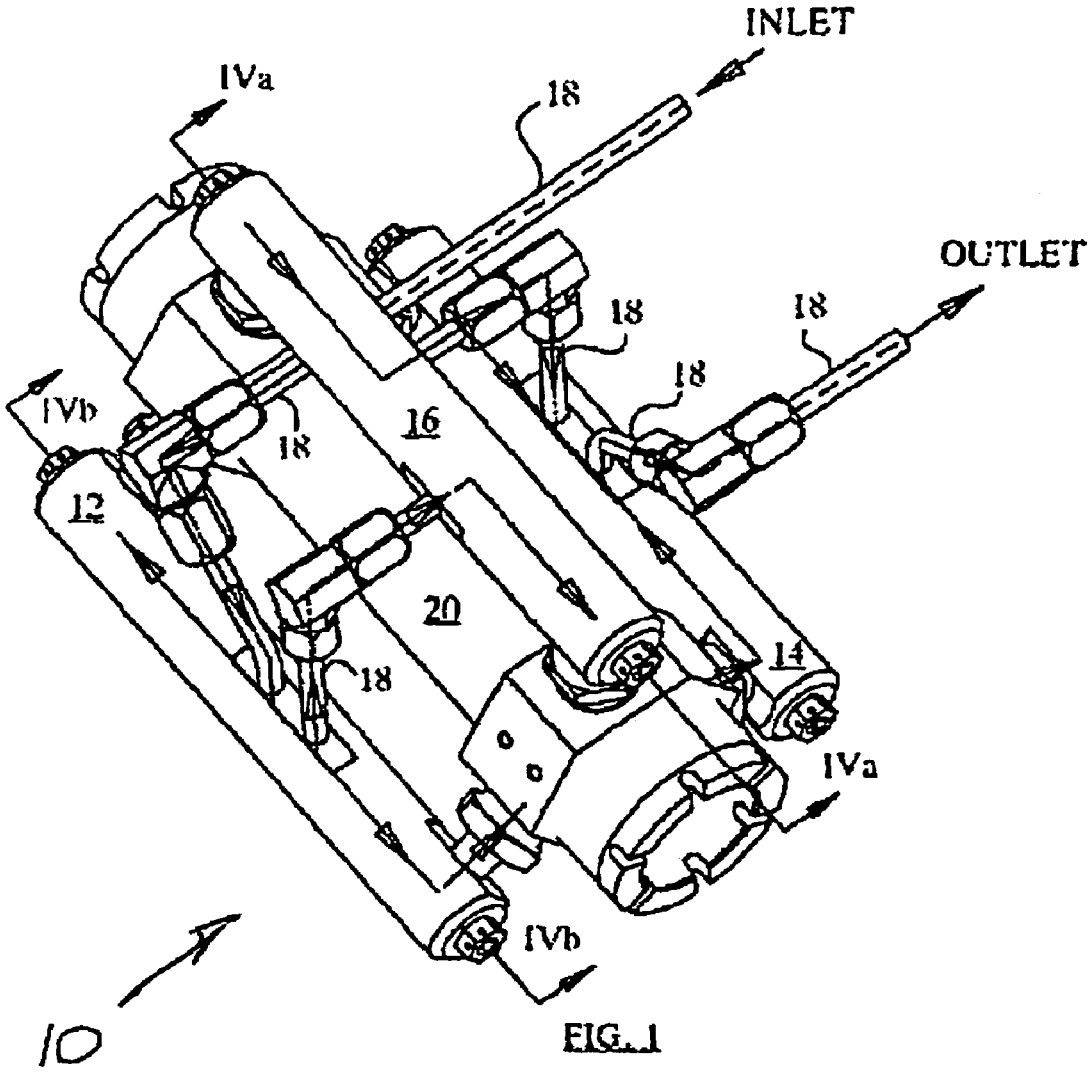
FIG. 1 is a left perspective view of a pump exemplary of an embodiment of the present invention.

FIG. 1 illustrates a pump 10 exemplary of an embodiment of the present invention. Pump 10 is well suited to pump fluids at high flow rates and high pressures. Pump 10 includes few moving parts and is relatively lightweight. It is well suited for use in fuel delivery systems and in particular for use in aircraft engines.

As illustrated pump 10 includes a single inlet and outlet. As will become apparent, pump 10 includes three individual pumping chambers housed with a pump body 20. An input manifold 12 distributes a single input to the three chambers. An output manifold 14 combines outputs of the three chambers. A cylindrical connecting pipe 16 interconnects pumping chambers. Pipes 18 interconnect pipe chambers to manifolds 12 and 14, and connecting pipe 16 for fluid coupling as illustrated by the arrows in FIG. 1.

Figure 2:
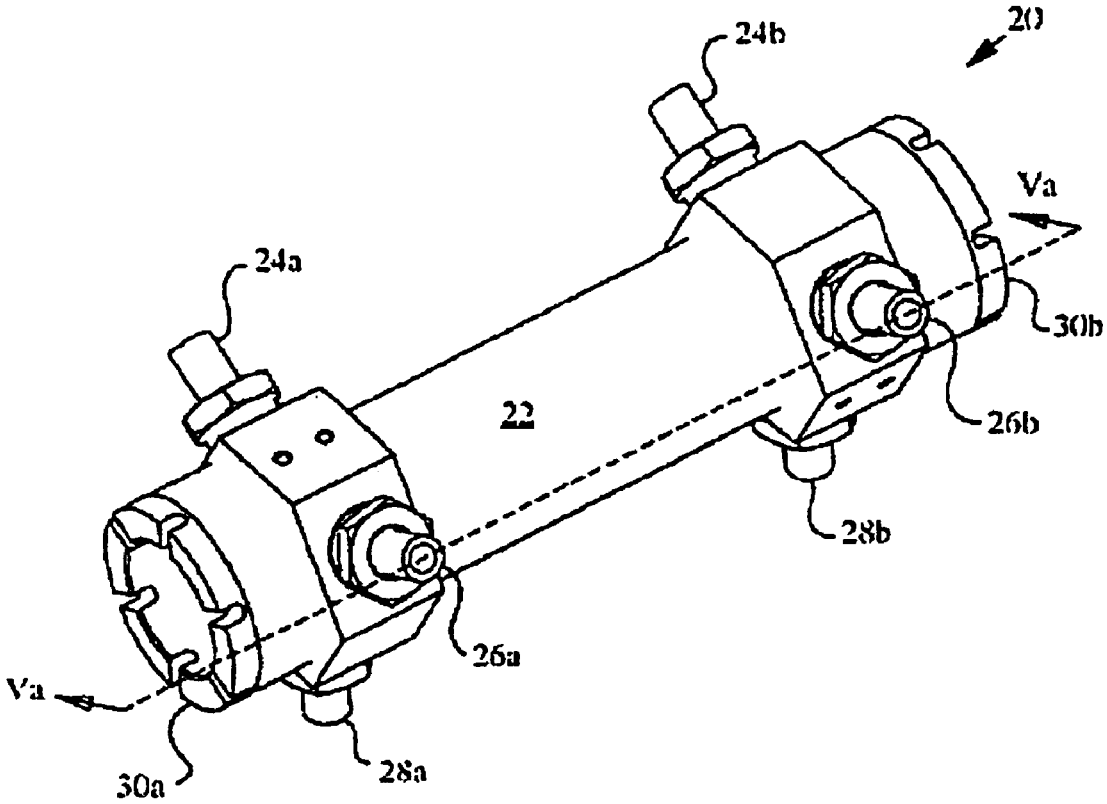
FIG. 2 is a right perspective view of a pump body of the pump of FIG. 1.

The exterior of pump body 20 is more particularly illustrated in FIG. 2. As illustrated pump body 20 includes an outer housing 22 that is generally cylindrical in shape. At its ends housing 22 is capped by threaded clamps 30*a* and 30*b*. Three one way flow valves 24*a*, 26*a*, 28*a* near one end of body 20, and three further one way flow valves 24*b*, 26*b*, 28*b* provide flow communication to three separate pumping chambers within pump body 20. As illustrated, in the exemplary embodiment three valves 24*a*, 26*a*, and 28*a* are spaced at 120.degree. about the periphery of housing 22, and extend in a generally radial direction from the center axis of housing 22. Valves 24*b*, 26*b* and 28*b* are similarly situated near the opposite end of housing 22.

Figure 3:
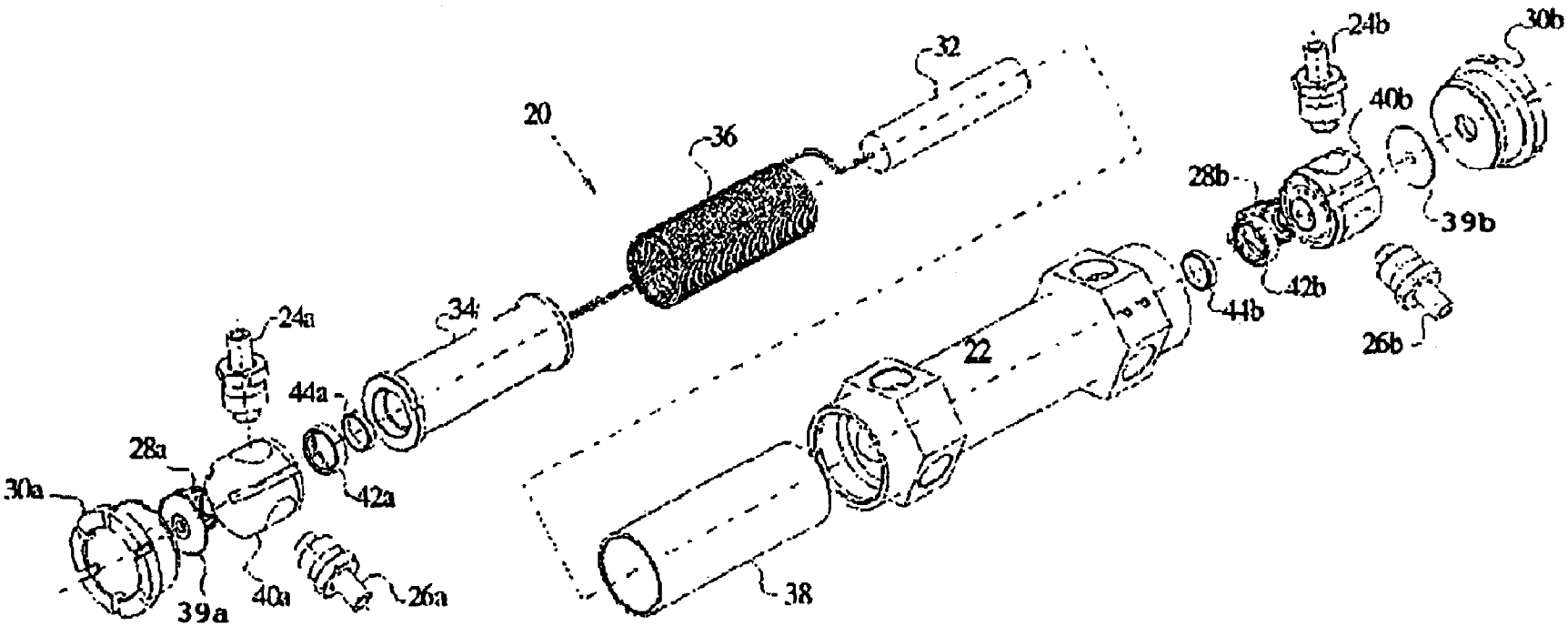
FIG. 3 is an exploded view of the pump body of FIG. 2.
Figure 5A:
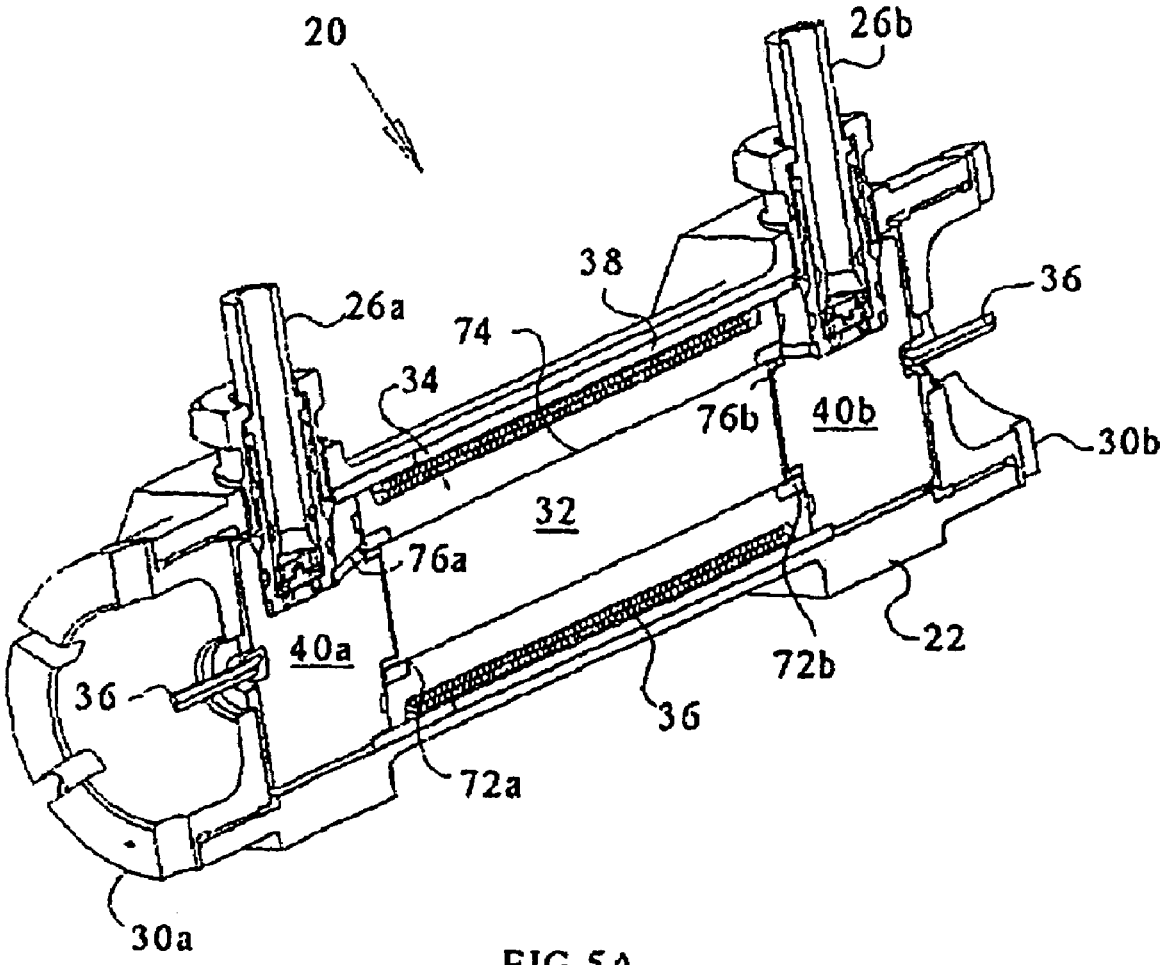
FIG. 5A is a right perspective cut away view of the pump body of FIG. 2 along lines V—V.
Figure 5B:
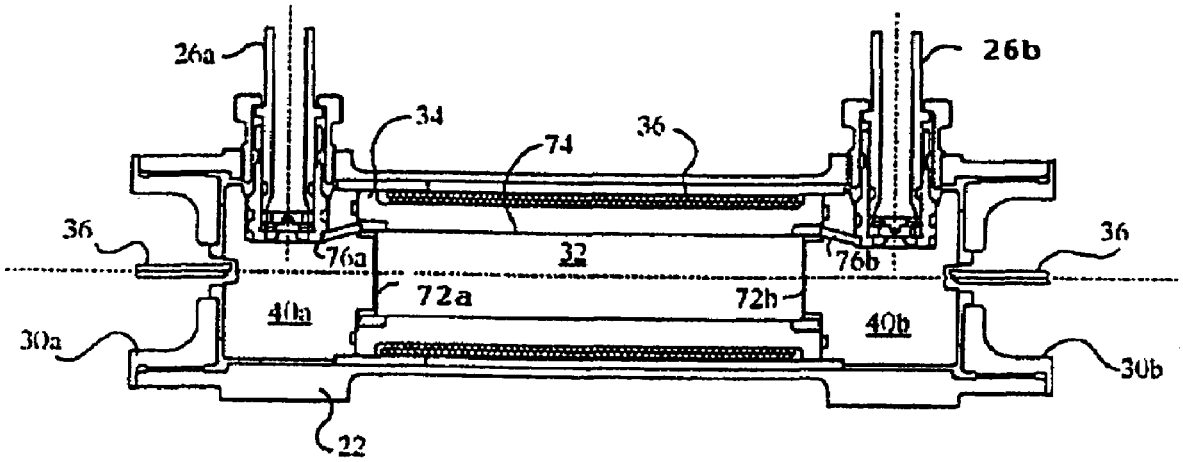
FIG. 5B is a right elevational view of FIG. 5A.

FIG. 3 is an exploded view of pump body 20, illustrating its assembly. FIGS. 5A, 5B and 6B are sectional views further illustrating this assembly. As illustrated, pump body 20 includes a lengthwise extending actuator 32. Preferably actuator 32 is cylindrical in shape. A multi-turn conducting coil 36 surrounds actuator 32 exterior to ceramic sheath 34. Radially exterior to coil 36 is a further cylindrical sheath 38. Exterior to sheath 34 is outer housing 22. Actuator 32, ceramic sheath 34, coil 36, sheath 38 and outer housing 22 are coaxial with a central axis of pump body 20.

Sheath 38 is preferably formed of a low conductivity soft magnetic material. It may for example be made of ferrite or from laminated or thin film rolled magnetic steel. In the exemplary embodiment, sheath 38 is made from a material made available in association with the trademark SM2 by MII Technologies. Valve seats 40*a* and 40*b* are similarly preferably formed of a magnetic material.

Sheath 38 and valve seats 40*a* and 40*b* are preferably formed of a magnetic material, as these at least partially define a magnetic circuit about actuator 32. The choice of materials affects magnetic losses (such as hysteresis and eddy-current losses) in these components.

Housing 22 is preferably made from a non-magnetic metal such as aluminum, stainless steel, or from a ceramic.

In the example embodiment, coil 36 is formed from about sixty two (62) turns of 15 awg wire. Of course, the number of turns and gauge of coil 36 is governed by its operating voltage, frequency and magnetic requirements (current).

As best illustrated in FIGS. 5A and 5B, actuator 32 is held in its axial position within outer housing 22 at its one end as a result of threaded clamp 30*a* providing an inward axial load on actuator 32 by way of a spacer 39*a*, valve housing 40*a* and spacer rings 42*a* and 44*a*. At its other end, actuator 32 is held in its axial position as a result of threaded clamp 30*b* providing an inward axial load on actuator 32 by way of a spacer 39*b*, valve housing 40*b* and spacer rings 42*b* and 44*b*. Spacers 39*a* and 39*b* are generally disk shaped washers formed of a somewhat resilient material, such as a polymer sold in association with the trademark VESPEL Retaining rings 42*a* and 44*a* (and 42*b* and 44*b*) are annular nested rings with ring 42*a* having a smaller diameter than ring 44*a*. The outer diameter of ring 42*a* is about equal to the diameter of actuator 32. Rings 42*a*, 42*b*, 44*a*, and 44*b*, too, are preferably formed of the polymer sold in association with the trademark VESPEL.

The spacer rings 44*a* and 44*b* serve three functions. First, spacer rings 44*a* and 44*b* act as load springs to provide an axial pre-load to actuator 32. Second, they form a seal at each end of the spacer 44*a* and 44*b*. Thirdly, they partially define pumping chambers 72*a* and 72*b*, as detailed below.

Spacer rings 42*a* and 42*b* similarly serve three functions. First, they provide radial support to actuator 32 to center it coaxial with cylinder 34. Secondly, rings 42*a* and 42*b* seal an annular compression chamber 74, at valve seats 40*a* and 40*b* and sheath 34. Thirdly, an annular manifold for the annular chamber is formed by the space between the rings 42*a* and 44*b* (and rings 42*b* and 44*b*).

The thickness of spacers 39*a* and 39*b* are chosen so that when the clamps 30*a* and 30*b* provide the required axial load on actuator 32 as clamps 30*a* and 30*b* are tightened completely to their mechanical stop. Essentially they are also used as springs. Conveniently spacers 39*a* and 39*b* also provide an insulated hole through which leads to coil 36 may be passed. Spacers 39*a* and 39*b* could of course, be replaced by a suitable washer.

Valve housings 40*a* and 40*b* seat valves 24*a*, 26*a*, 28*a* and 24*b*, 26*b*, 28*b* and provide flow communication between these valves and pumping chambers, as described below.

In the described embodiment of pump 10, actuator 32 has about a 0.787" diameter and a 4.00" length. Sheath 38 has 1.740" outside diameter, and a 1.560" inside diameter. Housing 22 has a total length of about 8.470". Sheath 34 has an inner diameter of about 0.797" and is about 4.350 in length.

Valves 24*a* 24*b*, 26*a*, 26*b*, 28*a* and 28*b* are conventional high speed check valves preventing flow into associated pumping chambers, capable of operating at about 2.5 KHz. These valves may, for example, be conventional Reed valves. The pressure drop required to open valves 24*a* 24*b*, 26*a*, 26*b*, 28*a* and 28*b* is preferably less than one (1) psi and the withstanding pressure (in the opposite direction) is over 2000 psi.

Figure 4A:
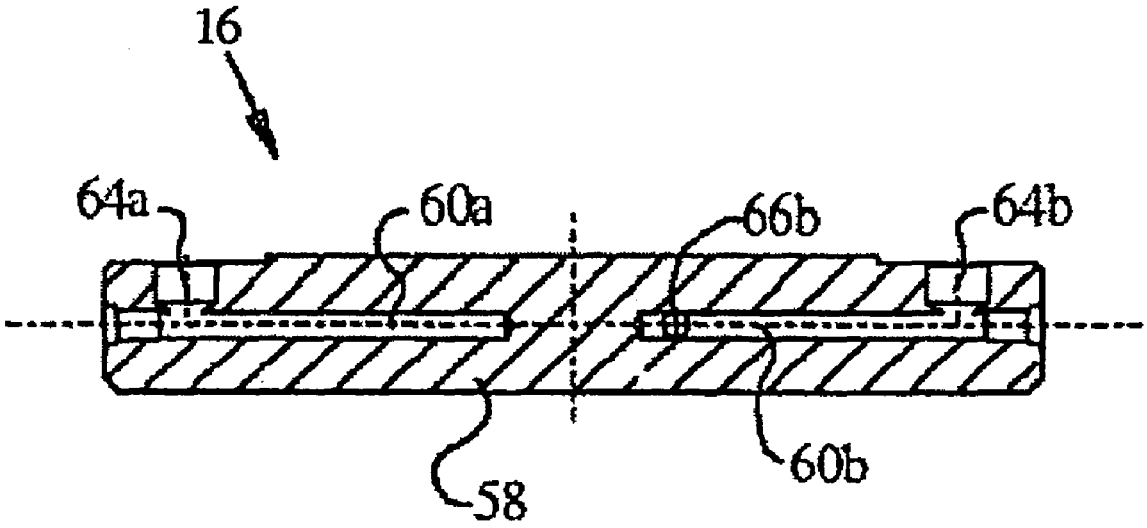
FIG. 4A is a cross sectional view of a component of the pump of FIG. 1 taken across lines IVa—IVa.
Figure 4B:
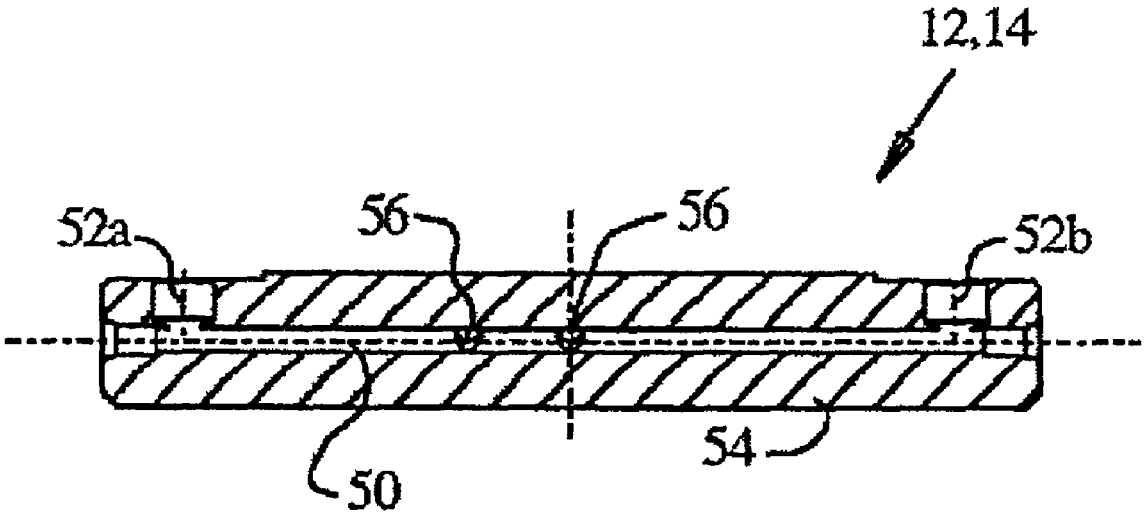
FIG. 4B is a cross sectional of a further component of the pump of FIG. 1 taken across lines IVb—IVb.

Exemplary manifolds 12 and 14 (FIG. 1) are identical in structure illustrated in cross-section in FIG. 4B. Manifold 12 acts as an intake manifold and is thus interconnected with inlet valves 24*a* and 28*a*. Manifold 14 acts as an output manifold, and is thus interconnected to outlet valves 24*b* and 28*b*. As illustrated in FIG. 4B, manifolds 12 and 14 each include an axial passageway 50 connecting two openings 52*a* and 52*b* in a cylindrical body 54, near its ends. Passageway 50 provides flow communication between these openings 52*a*, 52*b*. Openings 52*a* and 52*b* are spaced for interconnection between valves 24*a* an 24*b* or valves 28*a* and 28*b* (FIG. 1). Additional openings 56 permit interconnection of pipes 18 to passageway 50. Preferably, manifolds 12 and 14 are machined from a hard material such a metal (e.g. stainless steel, brass, copper, etc.).

Exemplary pipe 16 is similarly illustrated in cross section in FIG. 4A. As illustrated, pipe 16, includes two axial passageways 60*a* and 60*b* within an outer, generally cylindrical body 58. Each passageway interconnects and opening 64*a* or 64*b* for interconnection with valves 26*a* and 26*b* (FIG. 1). Two additional openings 66 (only one shown) are spaced 90. degree. from each other about the central axis of cylindrical body 58. Openings 66 allow interconnection of pipes 18 (FIG. 1) for flow communication with one of passageways 60*a* and 60*b*. Pipe 16 may be machined in a manner, and from a material similar to manifolds 12 and 14.

Figure 6A:
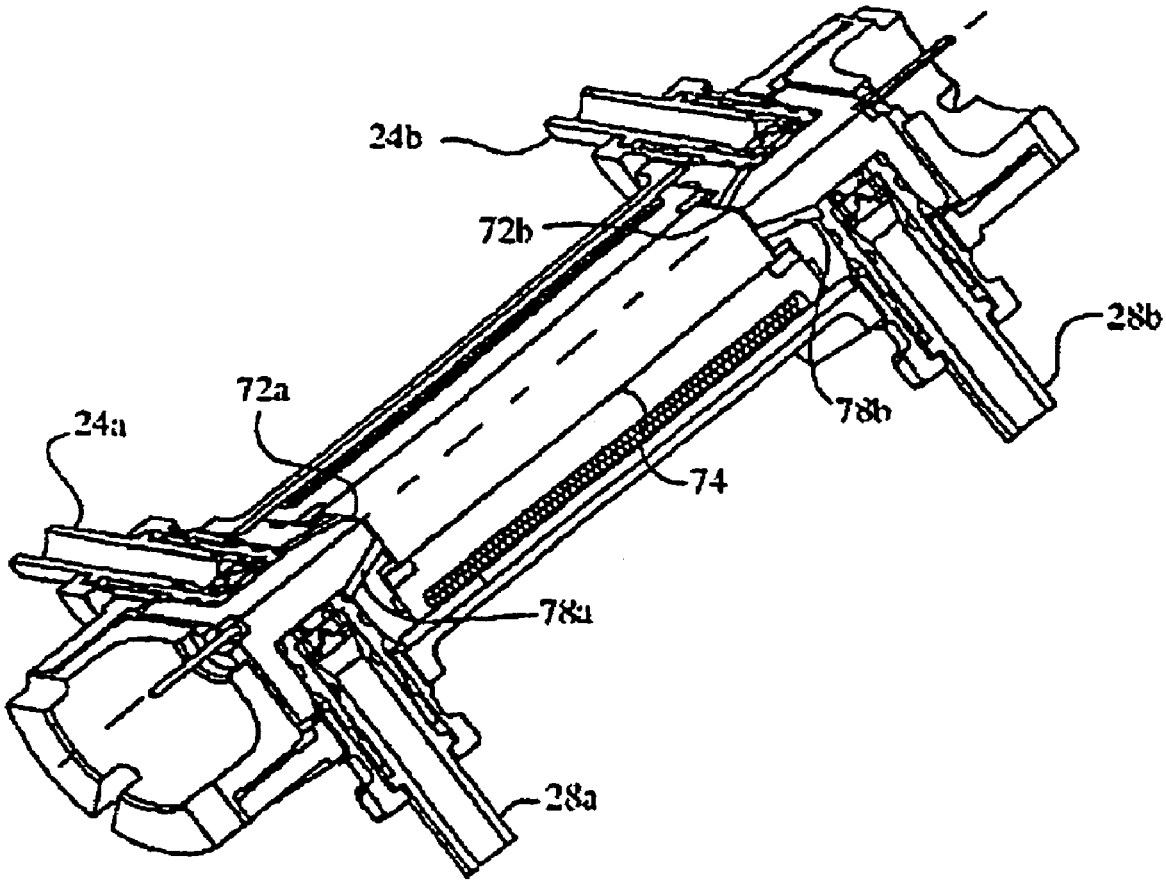
FIG. 6A is a further right perspective cut away view of the pumping body of FIG. 2.
Figure 6B:
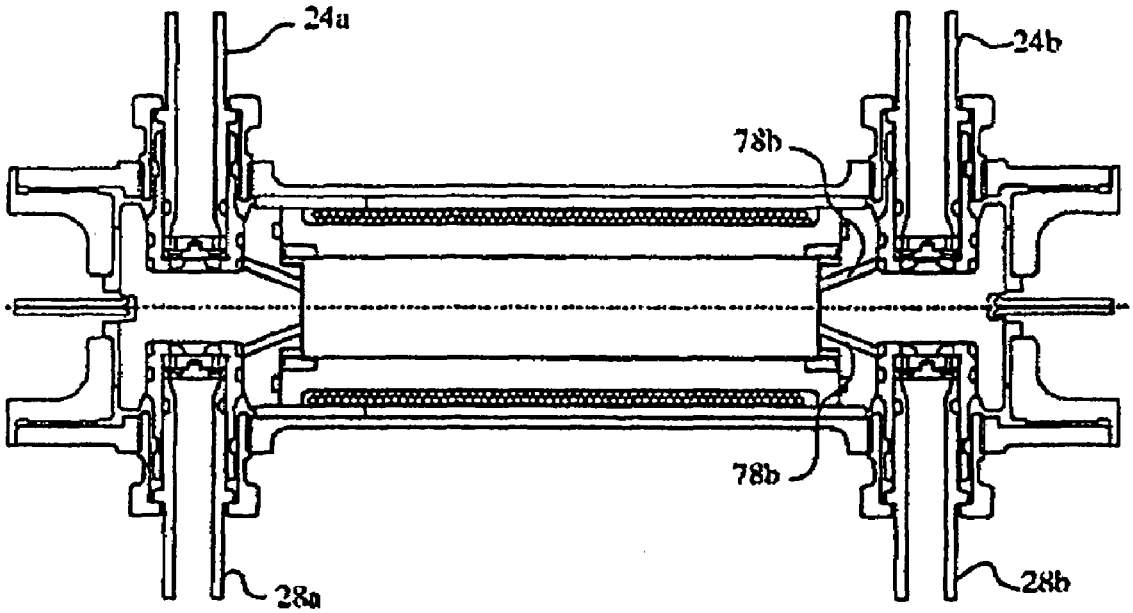
FIG. 6B is a top plan view of FIG. 6A.

Pumping chambers within pumping body 20 are more particularly illustrated in FIGS. 5A, 5B, 6A and 6B. FIGS. 5A and 6A are sectional views of pump body 20, illustrating its three pumping chambers 72*a*, 72*b* and 74. FIG. 5B is a right elevational view of FIG. 5A (and therefore a cross-sectional view of pump body 20). FIG. 6B is a top plan view of FIG. 6A. As illustrated, two end pumping chambers 72*a* and 72*b* are generally cylindrical in shape, and are located at distal ends of the lengthwise extent of actuator 32. Preferably, they are located directly between valve housing 40*a* and actuator 32, and valve housing 40*b* and actuator 32, respectively. They are defined in part by opposite flat ends of actuator 32 and flat ends of valve housing 40*a* and 40*b*. A further axial pumping chamber 74 is located between the exterior round surface of actuator 32, and an interior cylindrical surface of sheath 34. Axial pumping chamber 74 extends axially along the length of actuator 32, and is sealed at its ends by rings 42*a* and 42*b*.

Figure 7A:
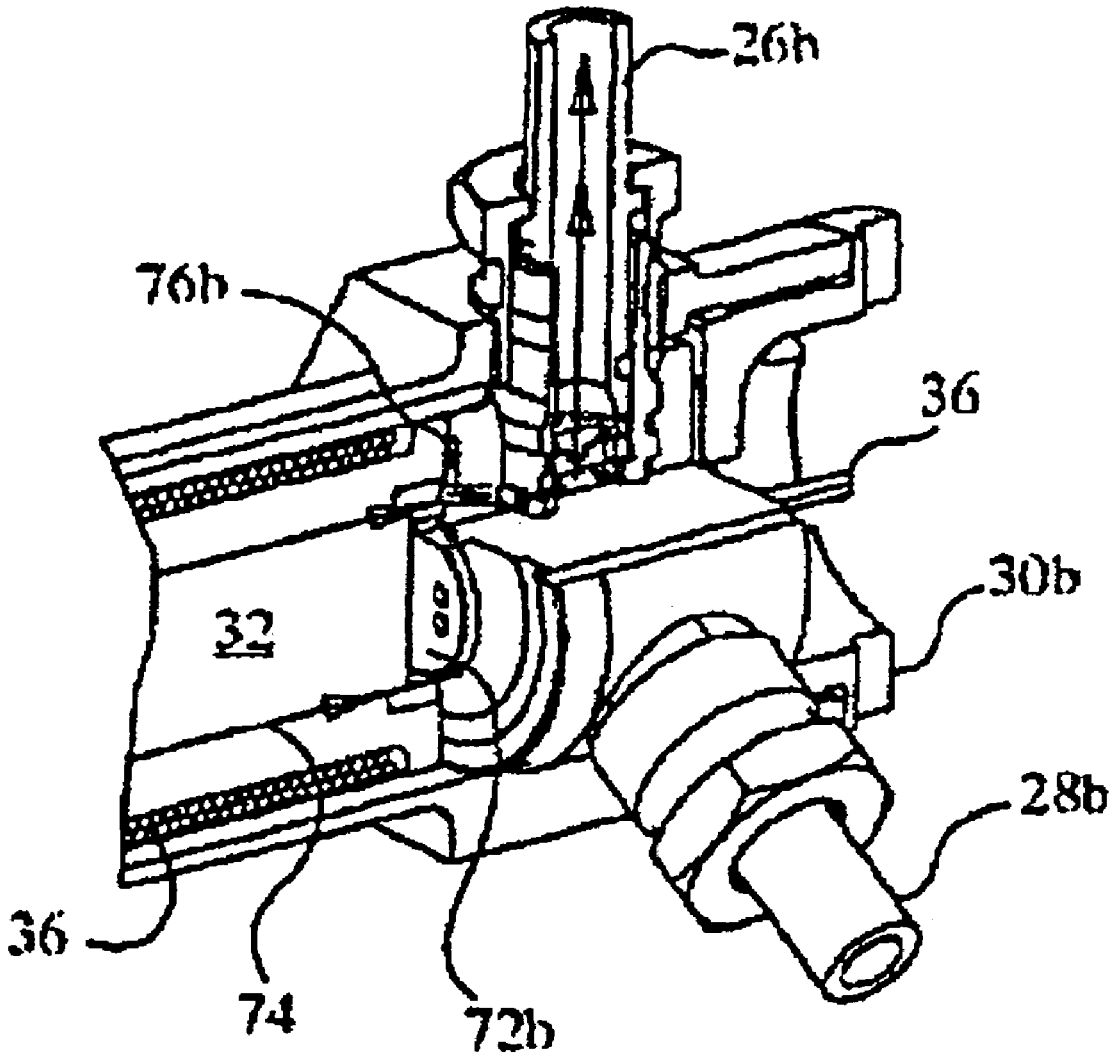
FIGS. 7A and 7B are enlarged sectional views of a portion of the pump body of FIG. 2.
Figure 7B:
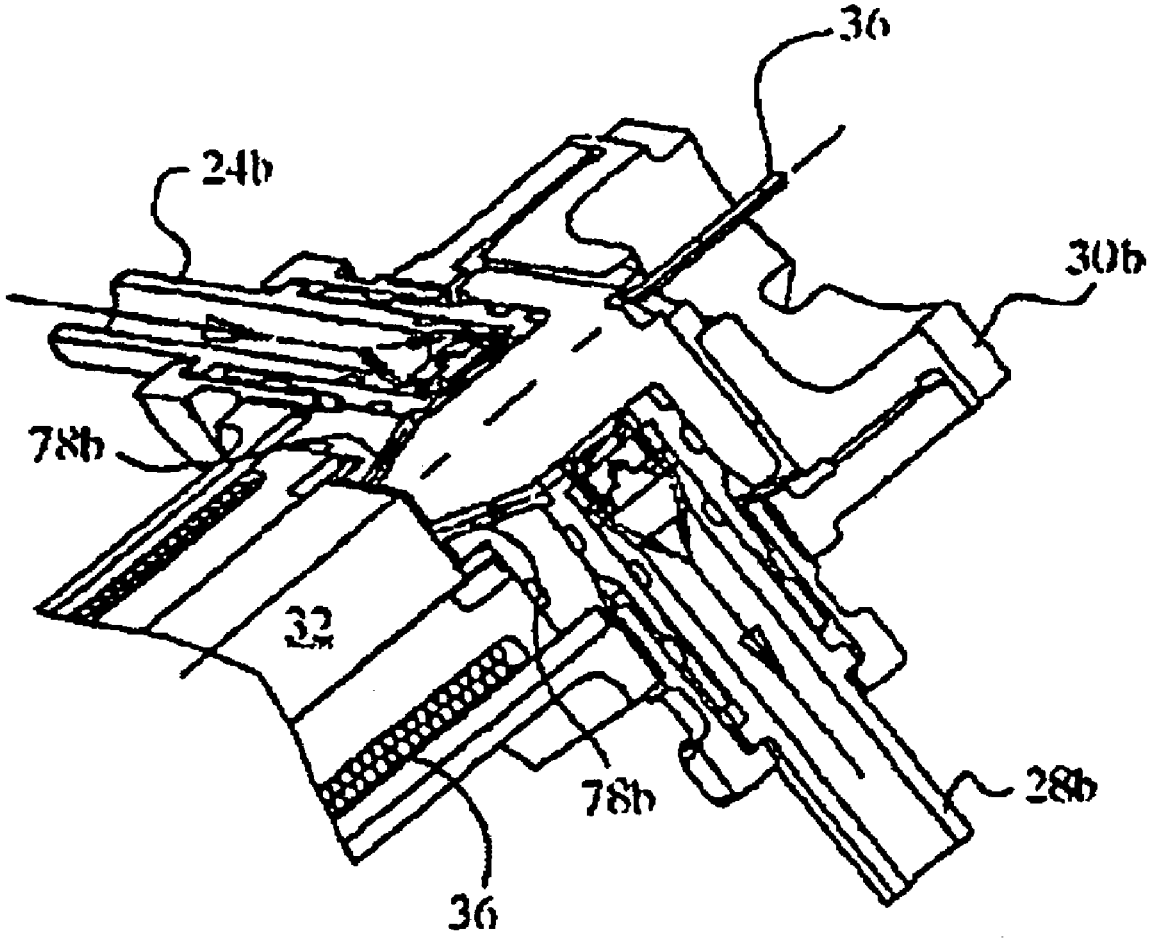

As illustrated in FIGS. 5A and 5B, axial pumping chamber 74 is in flow communication with valves 26*a* and 26*b*, by way of passageways 76*a* and 76*b* formed in valve housings 40*a* and 40*b*. Valve housing 40*b* is identical to housing 40*a* and is illustrated more particularly in FIG. 7A. As illustrated an annulus between rings 42*b* and 44*b* isolates end chamber 72*b* from axial chamber 74 and further provides flow communication from chamber 74 through passageway 76*b* to valve 26*b*. As will become apparent, fluid may thus be pumped from valve 26*a* through chamber 74 and out of valve 26*b*.

Cylindrical chamber 72*b* is in flow communication with valves 24*b* and 28*b*, by way of passageways 78*b* formed within valve housing 40*b*. As such, valve 24*b* and valve 28*b* act as inlet and outlet valves for end pumping chamber 72*b*. Valves 24*a* and 28*a* similarly serve as inlet and outlet valves, respectively, for pumping chamber 72*a*, as illustrated in FIGS. 6A and 6B.

Actuator 32 is preferably a cylindrical rod, formed of a conventional magnetostrictive material such as TERFENOL-D (an alloy containing iron and the rare earth metals turbium and dysprosium). As understood by those of ordinary skill, magnetostrictive materials change shape in the presence of a magnetic field, while, for all practical purposes, retaining their volume. Actuator 32, in particular, expands and contracts in a direction along its length and radius in the presence and absence of a magnetic field.

Rings 38 loaded by the force of threaded clamps 30*a* and 30*b* compress actuator 32 so that in the absence of a magnetic field, actuator 32 is contracted lengthwise. In the presence of a magnetic field actuator 32 lengthens in an axial direction, against the force exerted by rings 38. All the while the volume of actuator 32 remains constant. As such, an axial lengthening is accompanied by a radial contraction of actuator 32.

The expansion of actuator 32 in the presents of a magnetic field is a complex function of load, magnetic field and temperature but may be linear over a limited range. The expansion of the magnetostrictive material TERFENOL-D is in the range of 1200 to 1400 parts per million under proper load conditions and optimum magnetic field change. Example actuator 32, which is about 4" long, will expand about 0.0056" along its length while contracting in diameter about 0.00055" (static diameter is 0.787" ).

Figure 8:
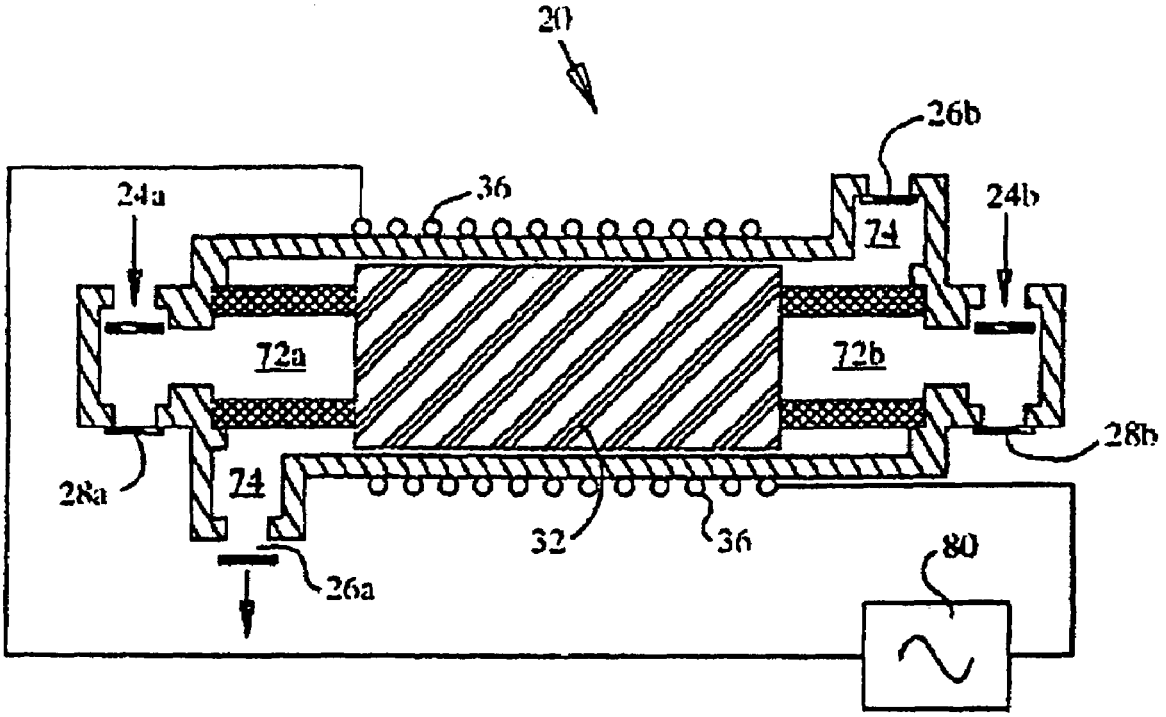
FIGS. 8 and 9 are schematic diagrams illustrating the pump of FIG. 1 in operation.
Figure 9:
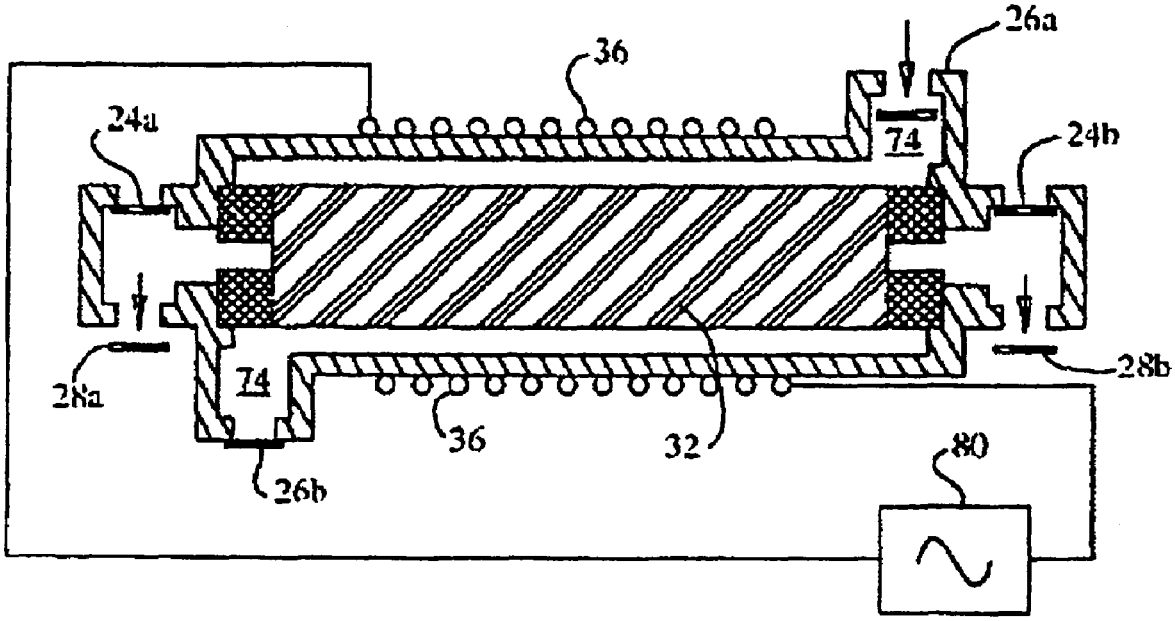

Operation of pump 10 may better be appreciated with reference to the schematic illustration of pump body 20 depicted in FIGS. 8 to 9. In operation, a source of alternating current (AC) source of electric energy 80 is applied to lead of coil 36. The frequency for example of the applied current could in this case be 1.25 Khz resulting in this arrangement of a lengthwise contraction expansion frequency of 2.5 Khz (the rod will expand with either polarity of applied magnetic field). Coil 36, in turn, generates an alternating magnetic field with flux lines along the axis of actuator 32. Sheath 38 forms a magnetic guide causing flux generated by coil 36 to be directed into and out of the ends of the rod, through valve seats 40*a* and 40*b*.

Conveniently, eddy current losses kept at a minimum in housing 22 and the valve seats 40*a* and 40*b*.

A fluid to be pumped is provided by way of the inlet of pump 10 (FIG. 1), pipes 16, and 18, and inlet manifold 12. Sheath 38 (FIG. 4) electrically insulates pump 10, so that current carried by coil 36 does not create substantial electromagnetic interference beyond housing 22.

As a result of the varying magnetic field generated by coil 36 and source 80, the shape of actuator 32 oscillates between a first state as illustrated in FIG. 8, and a second state as illustrated in FIG. 9. Transitions between these two states, in turn, cause changes in volume of pumping chambers 72*a*, 72*b* and 74, allowing these to act as positive displacement pumps.

As sheath 34 is made of a hard material such as ceramic, a radial expansion of actuator 38 and resulting displacement of the fluid within cavity 74 is resisted by sheath 34.

Specifically, as illustrated in exaggeration in FIG. 8, in a first state, actuator 32 has a minimum length and a maximum diameter. Chambers 72*a* and 72*b*, in turn, have increased volumes, resulting in reduced pressures therein, allowing passage of liquid through valves 24*a* and 24*b*, and preventing flow of liquid through valves 28*a* and 28*b*. Liquid may thus be drawn into chambers 72*a* and 72*b*. At the same time, the volume of chamber 74 is reduced, and liquid therein is displaced by actuator 32. One-way valve 26*a* remains closed, while valve 26*b* is opened, allowing fluid to be expelled from axial chamber 74.

As current flow of the source 80 varies, actuator 32 begins to expand axially and contract radially. One quarter period of oscillation of the electric source later, actuator 32 is in a second state, as illustrated in exaggeration in FIG. 9. In this state, actuator 32 has maximum length, and minimum diameter. As the length of actuator 32 increased it, in turn, displaces fluid in chambers 72*a* and 72*b*, increasing the pressure therein. At the same time, the volume of chamber 74 increases as a result of the radial contraction of actuator 32. The pressure in chamber 74, in turn, decreases. Valves 24*a* and 24*b* are closed, and valves 28*a* and 28*b* are open, allowing liquid to be expelled from chambers 72*a* and 72*b* through valves 28*a* and 28*b*. Similarly, valve 26*a* is opened and valve 26*b* is closed. Effectively, the pumping cycles of chamber 72*a* and 72*b* are in phase with each other, and 180.degree. out of phase with chamber 74.

For example pump 10, the total change (i.e. between minimum and maximum diameters of actuator 32) in the volume of axial pumping chamber 74 is 002724 cubic inches. As the annular chamber 74 expands and contracts twice in each cycle twice this volume could be displaced if there is little or no leakage and little or no compression of the working fluid. Thus, the displacement volume of chamber 74 is 0.00274 cubic inches per cycle of the actuator. Combining the displacement of chamber 74 with chambers 72*a* and 72*b* results in a total pump displacement of 0.0054 cubic inches per cycle of actuator 32. Thus at an excitation frequency (in the coil) of 1.25 Khz (corresponding to an actuator cycle frequency of 2.5 Khz) results in displacement of 2.5 Khz*0.0054 cu in =13.62 cubic inches per second or about 0.223 L/s. Thus, chambers 72*a*, 72*b* and 74 may produce a combined flow of up to about 1300 liters per hour at up to 4000 psi.

The pressure delivery of the pump depends on the compressibility of the pumped fluid as the cycle to cycle displacement is relatively small. However the pressure available from the TERFENOL-D is in excess of 8000 psi. Although impractical, if the fluid where not compressible the above noted flow rate previously calculated at 8000 psi might be realizable under ideal non leakage conditions. A practical result is expected to be up to 4000 psi at flow rates of up to 0.12 L/s for a single pump chamber.

Conveniently, pipes 16 and 18, and outlet manifold 14 join the output of pumping chambers 72*a*, 72*b* and 74 allowing these to act in tandem. Advantageously, as chambers 72*a* and 72*b* are 180.degree. out of phase with pumping chamber 74, interconnection of the three chamber provides a smooth pumping action, with two compression cycles for every cycle of actuator 32. Additionally, location of pumping chambers around the entire outer surface of actuator 32 allows forces within pump 10 to be balanced, reducing overall vibration of pump 10, during operation. Specifically, as the pressure of pumped fluid is equal all round actuator 32, net side forces are eliminated as a result and lateral vibration of the actuator 32 is reduced. The forces on actuator 32 due to pressure in the axial direction are balanced because the pressures from which the axial cavities are charged and discharged are the same because they are connected together and the end cavities are in phase.

More significantly, however, are the vibrational forces. If actuator 32 were fixed at one end, the acceleration forces related to the vibration of the actuator are reacted at the one end resulting in inertially related vibrations. In pump 10 two opposite ends of the actuator 32 accelerate in equal and opposite directions resulting in equal and opposite inertial forces which cancel. This results in a balanced system resulting in significantly less vibration and noise than could be obtained in conventional imbalanced arrangements.

Figure 10:
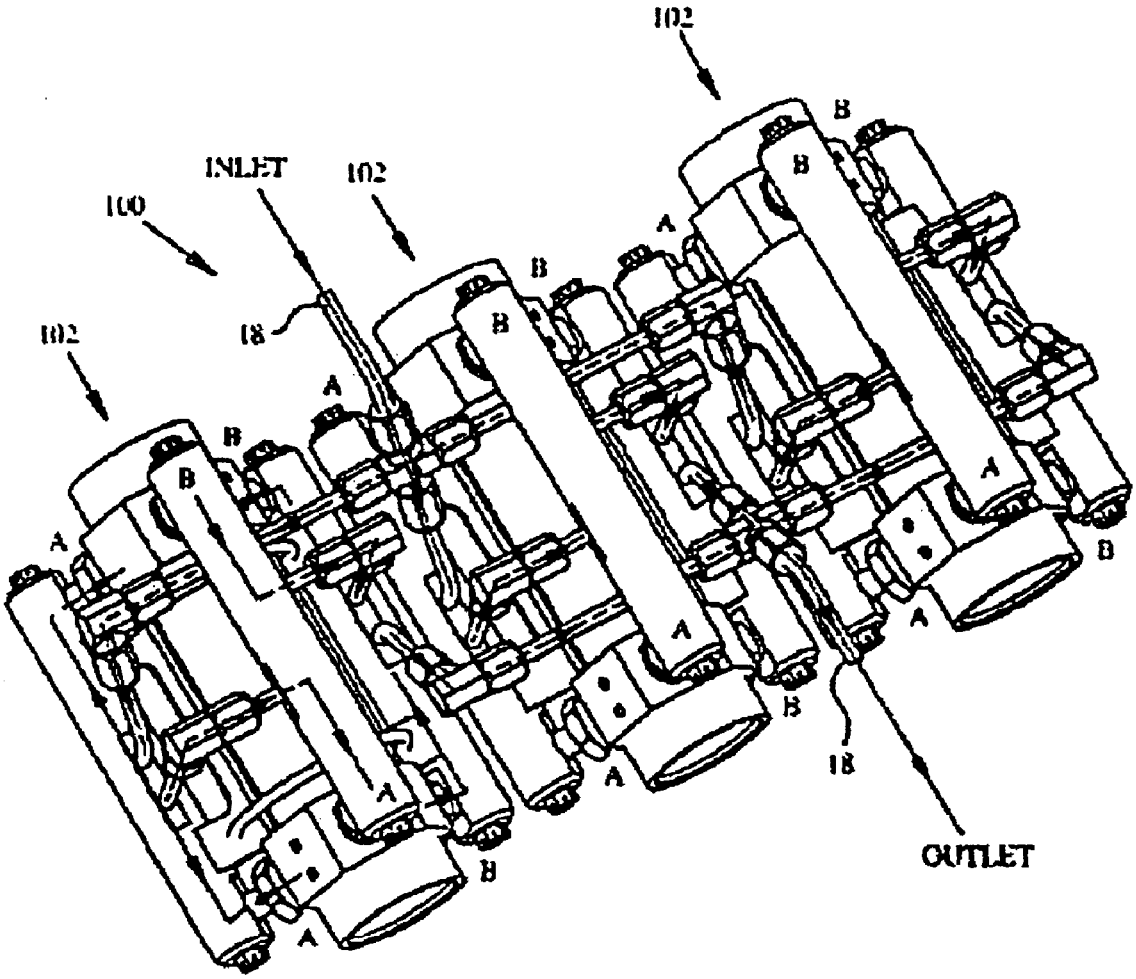
FIG. 10 illustrates a multi pump assembly exemplary of another embodiment of the present invention.

FIG. 10 further illustrates a multi-pump, pump assembly 100 including a plurality (three are illustrated) of pumps 102, each substantially identical to pump 10 (FIG. 1). As illustrated, pipes 18 interconnect pumps 102. Inputs and outputs of pumps 102 are connected in parallel. Pump assembly 100 may be beneficial if higher flow rates are required.

Conveniently, each pump of the pump assembly 100 may be driven out of phase from the remaining pumps. For example, for a three pump assembly, each pump 102 may be driven from one phase of a three phase power source (not shown), so that each pump 102 further smoothing any pressure fluctuations in output of any pump 102. Additionally this arrangement allows for redundancy as is often required for high reliability systems. Failure of one of the pumps 102 or one of the electrical phases would not cause total loss of flow.

Pump assembly 100 could similarly be arranged with inputs and outputs of pumps 102 interconnected in series. In this way, each pump 102 would incrementally increase pressure of a pumped fluid.

As should now be appreciated, the above described embodiments may be modified in many ways without departing from the present invention.

For example a pump and pump assembly could be machined and manufactured in many ways. One or more pumps may be cast in a body that does not have an outer cylindrical shape. Fluid conduit from and between pumps could be formed integrally in the cast body. Valves need not be arranged radially at 120° about an axis of an actuator, but could instead be arranged in along one or more axis of a body defining the pump.

An exemplary pump having only two pumping chambers will provide many of the above described benefits. For example, a pump having only two in-phase chambers (like end chambers 72*a*, 72*b*) driven by a single actuator may provide a balanced pump, with relatively few moving parts having only a single pumping stroke for a cycle of an actuator. Similarly, a pump having two chambers driven by a single actuator, with each of the pump chambers 180° out of phase with the other may provide relatively smooth pumping action. Of course, a pump having more than three chambers could be similarly formed.

Of course, a pump embodying the present invention may be formed with many configurations, in arbitrary shapes. For example, the pump assembly, housing and actuator need not be cylindrical. Similarly, pumping chambers need not be directly defined by a magnetostrictive element. Instead, an actuator may be mechanically coupled to the pumping chambers in any number of known ways. For example, the pumping chamber could be formed of a bellows driven a magnetostrictive actuator.

All documents referred to herein, are hereby incorporated by reference herein for all purposes.

Of course, the above described embodiments, are intended to be illustrative only and in no way limiting. The described embodiments of carrying out the invention, are susceptible to many modifications of form, arrangement of parts, details and order of operation. The invention, rather, is intended to encompass all such modification within its scope, as defined by the claims.

What is claimed is:

1. A pump comprising: a housing defining a cylindrical cavity; a cylindrical actuator formed of magnetostrictive material disposed within said housing and coaxial therewith; first and second pumping chambers within said housing at opposite ends of a lengthwise extent of said magnetostrictive actuator, said pumping chambers being mechanically coupled to said actuator to compress in equal and opposite directions as said actuator extends in length.

2. The pump of claim 1, wherein fluid in each of said first and second pumping chambers is displaced by a lengthwise extension of said actuator.

3. The pump of claim 2, further comprising a third chamber extending axially along a length of said actuator, fluid in said third chamber displaced by a radial expansion of said actuator.

4. The pump of claim 3, wherein inlets of said first, second, and third pumping chambers are fluidly coupled.

5. The pump of claim 4, wherein outlets of said first, second, and third pumping chambers are fluidly coupled.

6. The pump of claim 1, wherein said actuator has first and second ends, said first and second ends respectively providing a portion of said first and second pumping chambers, the first and second ends having substantially the same diameter.

7. A pump comprising a housing enclosing first and second pumping chambers and a magnetostrictive actuator, the actuator having first and second ends separated by a length of said actuator, the actuator extending between said first and second pumping chambers, said first and second ends respectively providing a portion of said first and second pumping chambers, said first and second pumping chambers compressing when the actuator increases in length, the first and second ends having substantially the same area.

8. The pump of claim 7, further comprising a third chamber extending between the housing and actuator along a length of said actuator, said third chamber compressing when the actuator increases in width.

* * * * *